US011019904B1

(12) United States Patent
Griffin

(10) Patent No.: US 11,019,904 B1
(45) Date of Patent: Jun. 1, 2021

(54) HAIR INTEGRATIONS PREPARATION SYSTEM AND METHOD OF USE

(71) Applicant: Destiny Griffin, Carrollton, TX (US)

(72) Inventor: Destiny Griffin, Carrollton, TX (US)

( * ) Notice: Subject to any disclaimer, the term of this patent is extended or adjusted under 35 U.S.C. 154(b) by 264 days.

(21) Appl. No.: 16/002,955

(22) Filed: Jun. 7, 2018

Related U.S. Application Data

(60) Provisional application No. 62/516,523, filed on Jun. 7, 2017.

(51) Int. Cl.

| | |
|---|---|
| ***A45D 20/08*** | (2006.01) |
| ***A45D 24/00*** | (2006.01) |
| ***A45D 24/10*** | (2006.01) |
| *A41G 5/00* | (2006.01) |

(52) U.S. Cl.
CPC ..... *A45D 24/007* (2013.01); *A45D 24/10* (2013.01); *A41G 5/0046* (2013.01)

(58) Field of Classification Search
CPC ..... A45D 24/007; A45D 24/10; A45D 8/00; A45D 7/00; A45D 6/00; A45D 2/04; A45D 2/24; A45D 2/2407; A45D 2/40; A45D 2/44; A45D 2/2457; A45D 2/2464; A45D 2007/002; A45D 2007/004; A45D 2007/005; A45D 19/0008; A45D 19/02; A45D 26/0038; A41G 3/00; A41G 3/0075; A41G 3/0083; A41G 5/00; A41G 5/004; A41G 5/0046; D04B 7/12; D04B 15/00; D01G 21/00; D01G 3/00; D02J 3/02; A01J 5/02
USPC ..... 132/119, 200, 201, 210, 212, 230, 245, 132/271
See application file for complete search history.

(56) References Cited

U.S. PATENT DOCUMENTS

| | | | | |
|---|---|---|---|---|
| 1,936,674 | A * | 11/1933 | Kecle | A45D 2/34 132/210 |
| 3,354,511 | A * | 11/1967 | Alexander | D02G 1/12 28/247 |
| 3,386,453 | A * | 6/1968 | Roberts | A45D 24/007 132/119.1 |
| 4,192,048 | A * | 3/1980 | Robillard | D02J 1/20 28/246 |
| 4,824,036 | A * | 4/1989 | Buta | A45D 2/00 132/212 |
| 5,460,191 | A * | 10/1995 | Bonomelli | A45D 2/00 132/212 |
| 5,725,000 | A * | 3/1998 | Rice | A45D 24/007 119/609 |
| 5,899,213 | A * | 5/1999 | Kimata | A45D 1/04 132/225 |
| 5,988,181 | A * | 11/1999 | Gable | A45D 2/00 132/200 |
| 6,647,989 | B1 * | 11/2003 | De Benedictis | A45D 2/00 132/210 |

(Continued)

FOREIGN PATENT DOCUMENTS

| | | | | |
|---|---|---|---|---|
| DE | 3904143 | A1 * | 2/1989 | B65D 35/285 |

*Primary Examiner* — Rachel R Steitz
(74) *Attorney, Agent, or Firm* — Richard Eldredge; Leavitt Eldredge Law Firm

(57) ABSTRACT

A hair integrations preparation system enables a user to rapidly tease hair by placing it in the intake port where it is held in a tube while it is teased by a set of rollers that travel along the tube. The hair is held in place by a series of wedges that constrict the tube. The ports, wedges, tube and rollers are held in a casing.

1 Claim, 4 Drawing Sheets

(56) References Cited

U.S. PATENT DOCUMENTS

| | | | | |
|---|---|---|---|---|
| 9,439,489 | B1 * | 9/2016 | Townsell | A45D 8/34 |
| 2006/0255065 | A1 * | 11/2006 | Crosby | A47K 1/09 222/102 |
| 2007/0017929 | A1 * | 1/2007 | Bracht | B65D 83/0072 222/101 |
| 2008/0000492 | A1 * | 1/2008 | Mills | B65D 83/0072 222/101 |
| 2012/0325262 | A1 * | 12/2012 | Sansole | A45D 7/00 132/210 |
| 2015/0007855 | A1 * | 1/2015 | Moloney | A45D 20/10 132/271 |
| 2016/0073755 | A1 * | 3/2016 | Xiao | A45D 1/04 132/230 |
| 2019/0191803 | A1 * | 6/2019 | Han | A41G 5/0046 |

* cited by examiner

HAIR INTEGRATIONS PREPARATION SYSTEM AND METHOD OF USE

BACKGROUND

1. Field of the Invention

The present invention relates generally to artificial hair systems, and more specifically, to a hair integration preparation system for preparing filament supplements prior to use in natural hair.

2. Description of Related Art

Artificial hair systems are well known in the art and are effective means to extend or alter the natural appearance of a user's hair. For example, FIG. 1 depicts a conventional weave 101 having a lock of weave 103 to be attached to a user's 105 natural hair 107. During use, the weave will be cut 109 and combed 111 to simulate natural looking hair 107.

One of the problems commonly associated with system 101 is its limited efficiency. For example, many weave strand are needed to properly augment a user's 105 natural hair 107, each strand must be teased by hand or with a comb which is tedious and time consuming. Additionally, during teasing the strands can become tangled and require sorting prior to attachment.

Accordingly, although great strides have been made in the area of conventional weave, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
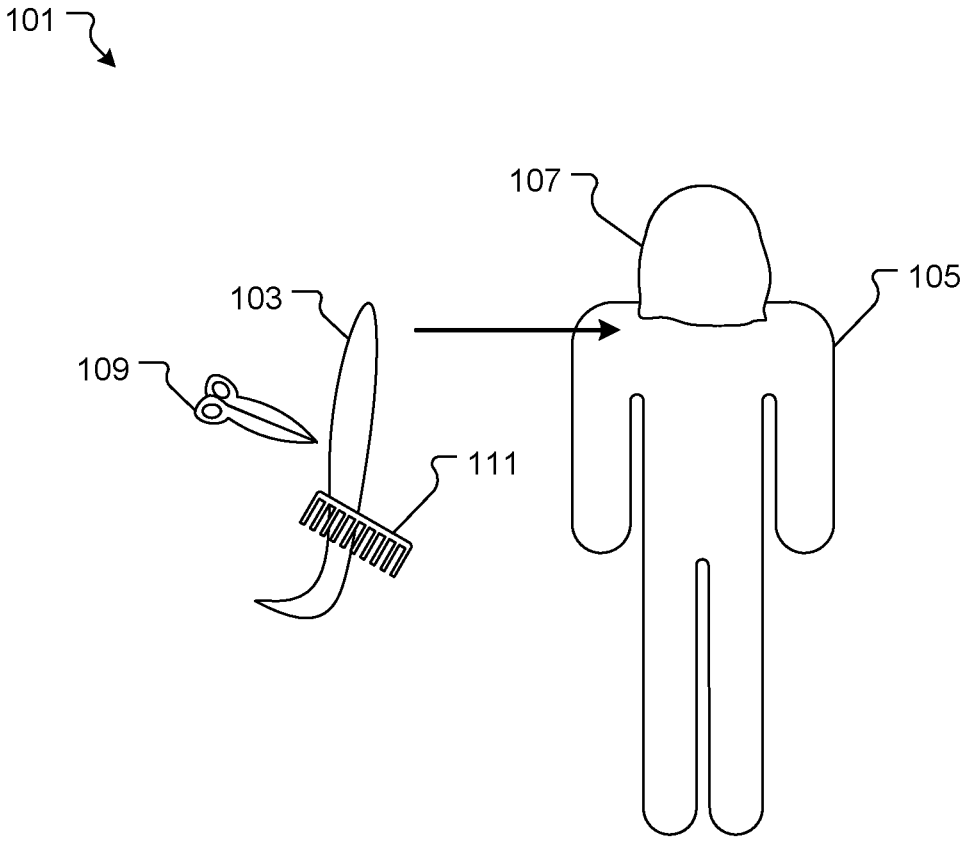
FIG. 1 (Prior Art)
FIG. 1 is a front view of a common weave attachment.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional weave. Specifically, the invention of the present application enables the rapid teasing of hair integrations prior to attachment. In addition, the strands do not become tangled and do not require sorting during teasing. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
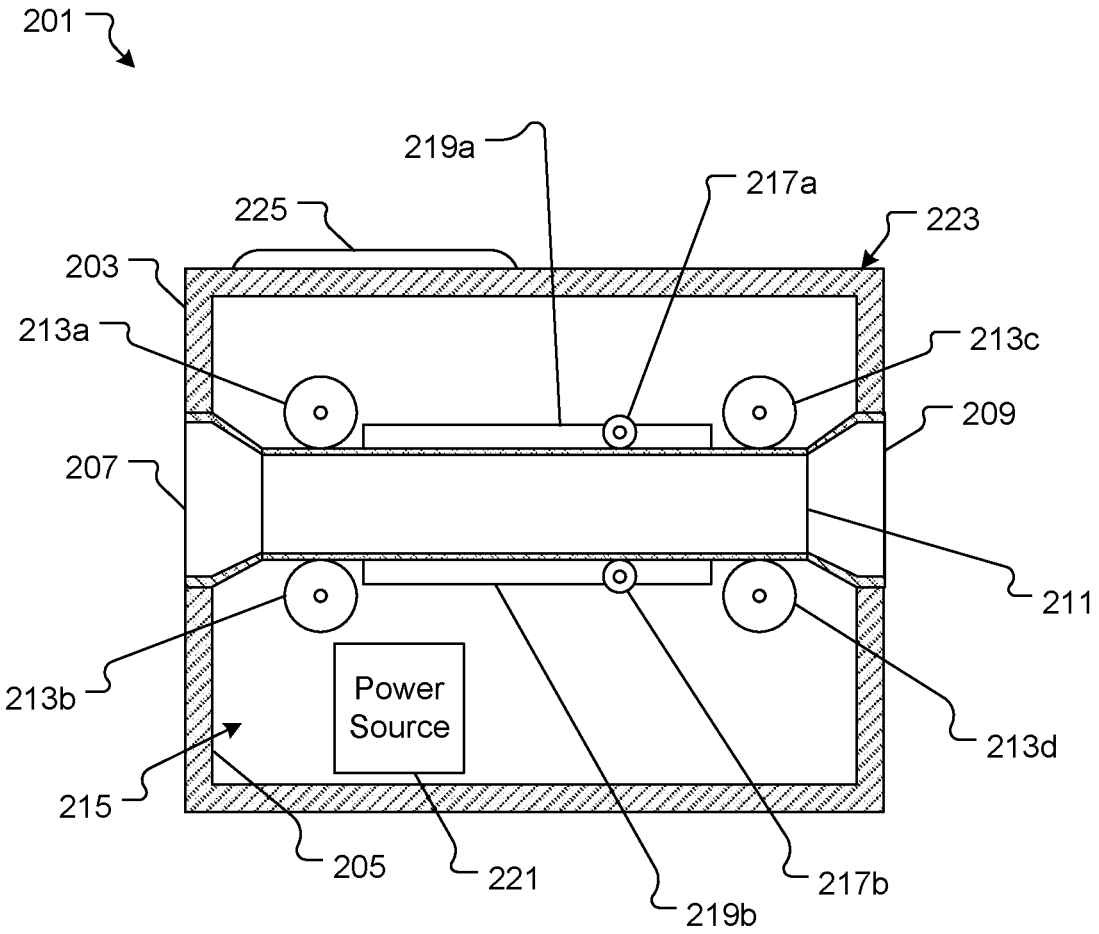
FIG. 2 is a cross-sectional front view of a hair integrations preparation system in accordance with a preferred embodiment of the present application.

Referring now to the drawings wherein like reference characters identify corresponding or similar elements throughout the several views, FIG. 2 depicts a cross-sectional front view of a hair integrations preparation system in accordance with a preferred embodiment of the present application. It will be appreciated that system 201 overcomes one or more of the above-listed problems commonly associated with conventional weave.

In the contemplated embodiment, system 201 includes casing 203 that encloses an interior space 205. The interior space 205 having an intake port 207 and exit port 209 attached to opposite sides of the casing 203. The intake port 207 and exit port 209 connected via a tube 211.

The interior space 205 having a plurality of wedges 213 configured to contract and grip any contents of tube 211. A set of rollers 217 translationally attached to the interior space 205 via tracks 219. The rollers 217 being configured to alternate between squeezing and pulling the contents of tube 211.

The casing 203 having a control interface 225 attached to the top surface 223 and in electronic communication with the wedges 213, rollers 217 and a power source 221.

In use, hair integrations are feed in the intake port 207 so that they can be held in place by wedges 213. The system 201 is activated via the control interface 225. The tube 211 is squeezed by the wedges 213 to fix the hair integrations with respect to the tube 211. Rollers 217 traverse the tracks

219 and tease the hair integrations in the tube 211. When teasing is complete, the hair integrations are removed through the exit port 209.

It should be appreciated that one of the unique features believed characteristic of the present application is that the wedges 213 and rollers 217 enable the rapid teasing of air integrations. It should also be appreciated that tube 211 prevents the integrations from becoming tangled while they are teased.

Figure 3:
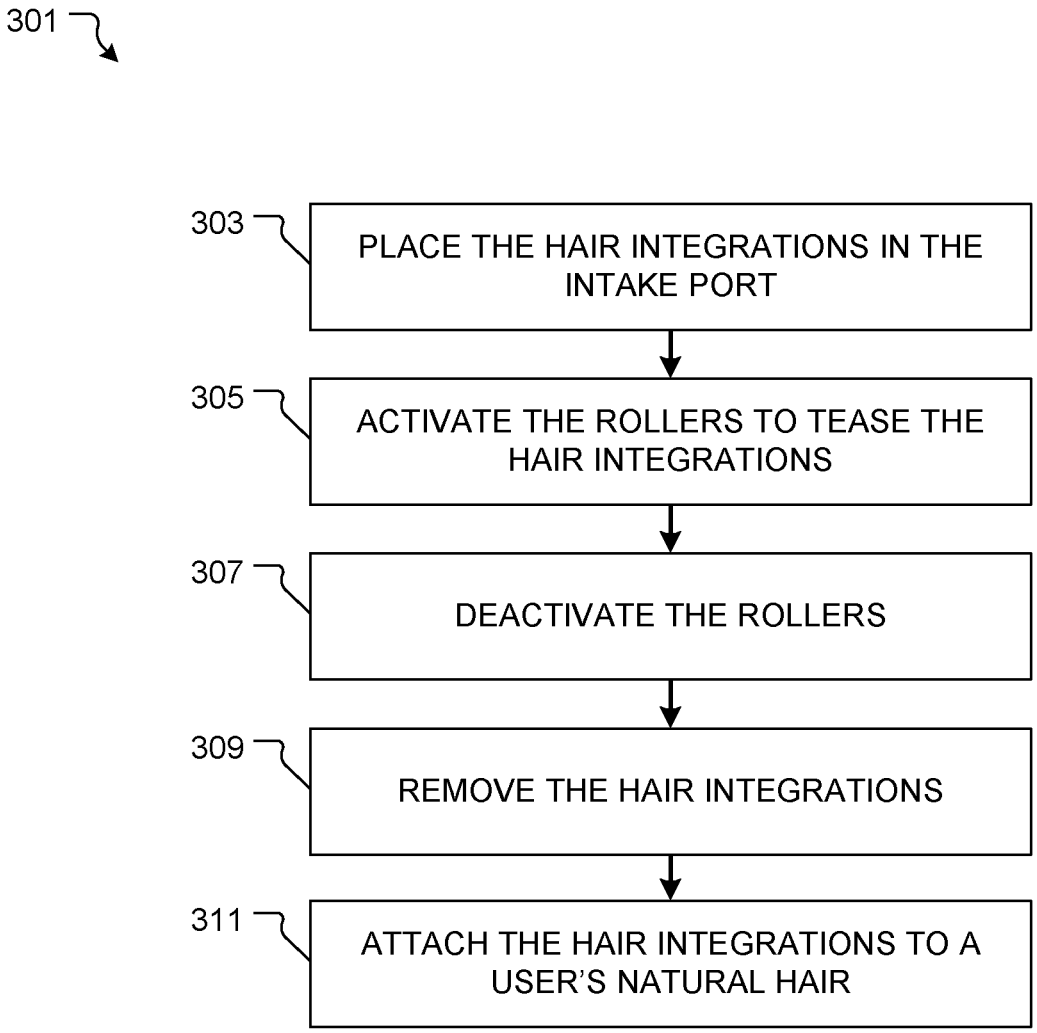
FIG. 3 is a flowchart of the preferred method of use of the system of FIG. 2.

Referring now to FIG. 3 the preferred method of use of system 201 is depicted. Method 301 including placing the hair integrations in the intake port 303, activating the rollers via the control interface to tease the hair integrations 305, deactivating the rollers via the control interface 307, removing the hair integrations from the tube 309 and attaching the hair integrations to a user's natural hair 311.

Figure 4:
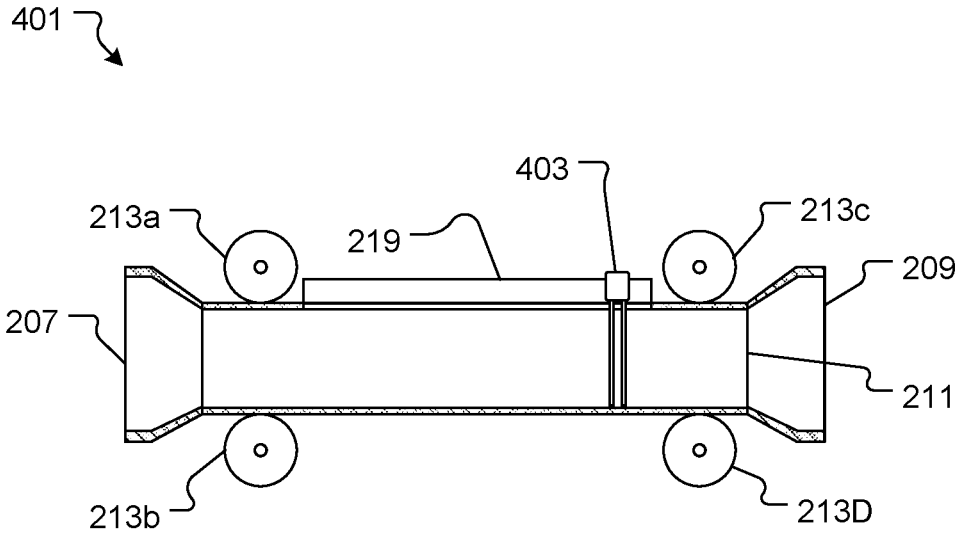
FIG. 4 is a cross-sectional front view of an alternative embodiment of the tube of FIG. 2.

Referring now to FIG. 4 a cross-sectional front view of an alternative embodiment of the tube 211 of system 201 is depicted. Embodiment 401 having similar features as system 201 however roller 217 has been replaced with a comb 403. The comb 403 configured to traverse track 219 and tease the contents of tube 211.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed:

1. A hair integrations preparation system comprising:

a casing having an interior space having an intake port and an exit port attached to different sides;

the intake port and exit port both attached to a tube;

the tube having a plurality of wedges configured to squeeze the tube to hold a hair integrations in place;

the tube also having a plurality of rollers that traverse the tube alternating between squeezing and pulling the hair integrations within the tube;

the rollers traversing the tube via a plurality of tracks;

the casing having a control interface attached to a top surface and in electronic communication with the wedges, roller and a power source;

wherein the hair integrations are placed in the tube to be teased prior to attachment to a user's hair.

* * * * *